US007574996B2

(12) United States Patent
Hasenauer et al.

(10) Patent No.: US 7,574,996 B2
(45) Date of Patent: Aug. 18, 2009

(54) FUEL SUPPLY SYSTEM WITH A GAS ADSORPTION DEVICE

(75) Inventors: Dieter Hasenauer, Weinheim (DE); Ulrich Eberle, Mainz (DE); Rittmar Von Helmolt, Erlangen (DE)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/877,090

(22) Filed: Oct. 23, 2007

(65) Prior Publication Data

US 2009/0101118 A1 Apr. 23, 2009

(51) Int. Cl.
*F02M 33/08* (2006.01)
*F02M 33/02* (2006.01)

(52) U.S. Cl. ..... 123/519

(58) Field of Classification Search ..... 123/519, 123/520, 518, 516; 420/900; 206/0.7; 502/526; 423/248, 648.1
See application file for complete search history.

(56) References Cited

U.S. PATENT DOCUMENTS 3,350,229 A * 10/1967 Justi ..... 429/17
6,309,446 B1 * 10/2001 Nakanoya et al. ..... 95/102
6,739,350 B1 * 5/2004 Op De Beeck et al. ..... 137/202
6,748,748 B2 * 6/2004 Bradley et al. ..... 62/46.1
7,431,151 B2 * 10/2008 Hosoe et al. ..... 206/0.7
2003/0175563 A1 * 9/2003 Bruck et al. ..... 429/19
2003/0226365 A1 12/2003 Bradley et al.
2004/0031387 A1 2/2004 Jhi et al.
2004/0040316 A1 3/2004 Bradley et al.
2006/0019162 A1 * 1/2006 Shirahige et al. ..... 429/218.2
2006/0054022 A1 * 3/2006 Hosoe et al. ..... 96/108
2006/0199064 A1 9/2006 Arnold et al.
2007/0180998 A1 8/2007 Arnold et al.
2007/0214830 A1 9/2007 Arnold et al.
2007/0261552 A1 11/2007 Arnold et al.
2008/0268303 A1 * 10/2008 Eickhoff ..... 429/19
2008/0277380 A1 * 11/2008 Christenson et al. ..... 216/56

FOREIGN PATENT DOCUMENTS

WO WO 03/050036 6/2003

* cited by examiner

*Primary Examiner*—Mahmoud Gimie
(74) *Attorney, Agent, or Firm*—Reising Ethington P.C.

(57) ABSTRACT

Disclosed is a process of supplying a gaseous fuel from a fuel storage vessel to a secondary device.

25 Claims, 2 Drawing Sheets

FUEL SUPPLY SYSTEM WITH A GAS ADSORPTION DEVICE

TECHNICAL FIELD

The disclosure generally relates to a method for supplying fuel to a secondary device.

BACKGROUND

Several methods are available for storing sufficient amounts of fuel for introduction into a fuel cell or a related device. One method requires high pressure vessels at pressures up to 70 MPa. Another method places a gas absorbing material, such as TiCrMn-alloy, within a storage vessel to increase capacity. Another method uses a cryogenic liquid to store liquid fuel at cryogenic temperatures. Another storage option stows increased amounts of fuel within a storage vessel by utilizing high-surface materials such as activated carbons, zeoliths, metal-organic frameworks, or polymers of intrinsic microporosity.

SUMMARY OF THE DISCLOSURE

One embodiment of the disclosure includes a process comprising supplying a gaseous fuel from a fuel storage vessel to a secondary device. The fuel storage vessel may include a gas adsorbing material to enhance the storage capacity of the fuel storage vessel.

Another embodiment of the disclosure may include a process allowing the storage vessel to supply fuel to a secondary device at a predetermined feed pressure. When necessary, a gas compressor activates to assist in supplying fuel to the secondary device at the predetermined feed pressure.

Other exemplary embodiments of the disclosure will become apparent from the detailed description. It should be understood that the detailed description and specific examples, while indicating the exemplary embodiments of the disclosure, are intended for illustration purposes only and not intended to limit the scope of the invention.

BRIEF DESCRIPTION OF THE DRAWINGS

The disclosure will now be described, by way of example, and not limitation, with reference to the accompanying drawings. The following is a brief description of the drawings.

DETAILED DESCRIPTION OF EXEMPLARY EMBODIMENTS

Figure 1:
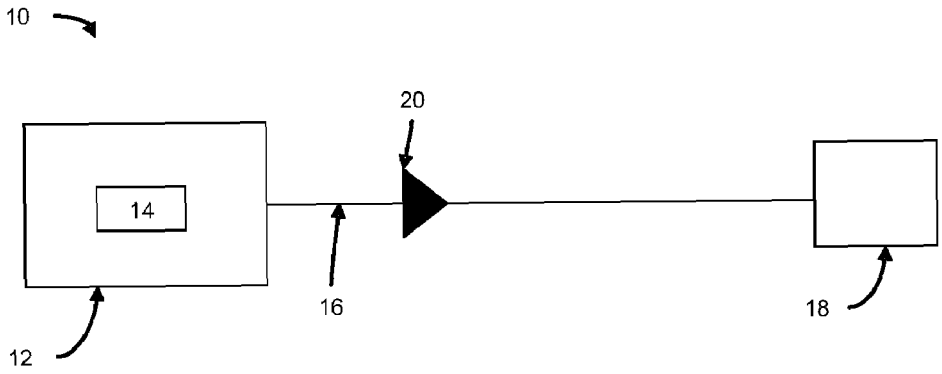
FIG. 1 is a schematic view of fuel supplying system suitable for implementation of a process according to one or more embodiments of the invention.

Referring now to FIG. 1, one embodiment of a fuel supplying system is provided as reference numeral 10. The system 10 is suitable for use wherever fuel needs to be stored and transferred. The system 10 may include a fuel storage vessel 12 which may include a gas adsorbing material 14. The gas adsorbing material 14 may be any material known to those skilled in the art for adsorbing fuel such as hydrogen or methane. For example, for hydrogen storage, the adsorbing material may be a metal hydride, chemical hydride, carbon-based material, a metal-organic framework (MOF) or a zeolite. In various embodiments, the adsorbing material may be at least one of an alanate ($AlH_4$), LiH, NaH, $MgH_2$, $C_{10}H_{18}$, activated carbon powder, or activated carbon pellets. A suitable carbon powder useful in various embodiments is available under the tradename AX-21 or MSC-30. A suitable MOF powder useful in various embodiments is available under the tradename MOF5, MOF177 or Basolite.

Fuel is introduced into the storage vessel 12 which houses the gas adsorbing material 14. The gas adsorbing material 14 allows for increased storage capacity of the fuel at moderate operating conditions. The gas adsorbing material's 14 storage capacity can be maximized at higher pressures and lower temperatures. In one embodiment, the fuel storage vessel 12 may be refueled to a high pressure so as to adsorb the most amount of fuel possible. In another embodiment, while defueling, or supplying fuel to a secondary device 18, the pressure in fuel storage vessel 12 may decrease. A decrease in pressure of the fuel storage vessel 12 assists in releasing as much fuel from the gas adsorbing material 14 as possible. For example, in various embodiments, the pressures in fuel storage devices containing gas adsorbing materials may range from up to 100 bars when full and down to 0.3 bars when empty, and up to 25 bars when full and down to 1 bar when empty. In other embodiments, temperatures for a fuel storage vessel containing a gas adsorbing material range from 25 K to 200 K.

A fuel supply line 16 may be connected to the fuel storage vessel 12 in order to pass fuel from the fuel storage vessel 12 to a secondary device 18. Generally, the secondary device 18 is a type of fuel consuming device such as, but not limited to, a fuel cell or a combustion engine. If the secondary device 18 is a fuel cell or a combustion engine, possible fuels include hydrogen and methane. However, the secondary device 18 may also be another storage container such as a transportation vessel, a filling vessel at a filing station, a personal storage vessel, or the like, in which case possible fuels include any fuel required to be transported or delivered in a gaseous state.

In various embodiments, fuel may be supplied to a secondary device 18 at a predetermined feed pressure of about 3 bars or greater, 3 to 7 bars, or 5 bars. One way to supply feed pressure to the secondary device 20 is to utilize the pressure of the fuel storage vessel 12. For example, the fuel storage vessel 12 can provide the necessary feed pressure to deliver fuel to the secondary device 18 when the fuel storage vessel 12 is full or mostly full. However, the pressure in the fuel storage vessel 12 might decrease as fuel is removed and supplied to the secondary device 18. As mentioned above, a decrease in pressure of the fuel storage vessel 12 aids the gas adsorbing material 14 in releasing fuel. Eventually, the pressure in the fuel storage vessel 12 might fall to levels at or below the predetermined feed pressure of the secondary device 18. At that point, the fuel storage vessel 12 might not be able to supply sufficient fuel to the secondary device 18 on its own. Therefore, any remaining fuel stored in the fuel storage vessel 12, which can be significant for vessels containing a gas adsorbing material, will go unused.

In one embodiment, a gas compressor 20 can be utilized to extract additional fuel from the fuel storage vessel 12 and supply it to the secondary device 18 at the predetermined feed pressure. The type of gas compressor used may be any gas compressor known to those of ordinary skill in the art such as, but not limited to, reciprocating compressors, rotary screw compressors, centrifugal compressors, axial-flow compressors, and scroll compressors. The gas compressor 20 may be located in the fuel supply line 16 or in a separate line. The gas compressor 20 allows for the fuel storage device 12 to be operated at a pressure lower than the predetermined feed pressure in order to release additional amounts of fuel from the gas adsorbing material 14.

In an embodiment without a gas compressor 20, the fuel storage vessel 12 might be limited to high operating pressures capable of providing the predetermined feed pressure to the secondary device 18. These high operating pressures are inefficient because the gas adsorbing material 14 can store sufficient amounts of fuel at pressures below the feed pressure of the secondary device 18. Therefore, when limited to high operating pressures, only a portion of the fuel storage vessel's 14 storage capacity is delivered to the secondary device 18 and more frequent refueling may be required.

Figure 4:
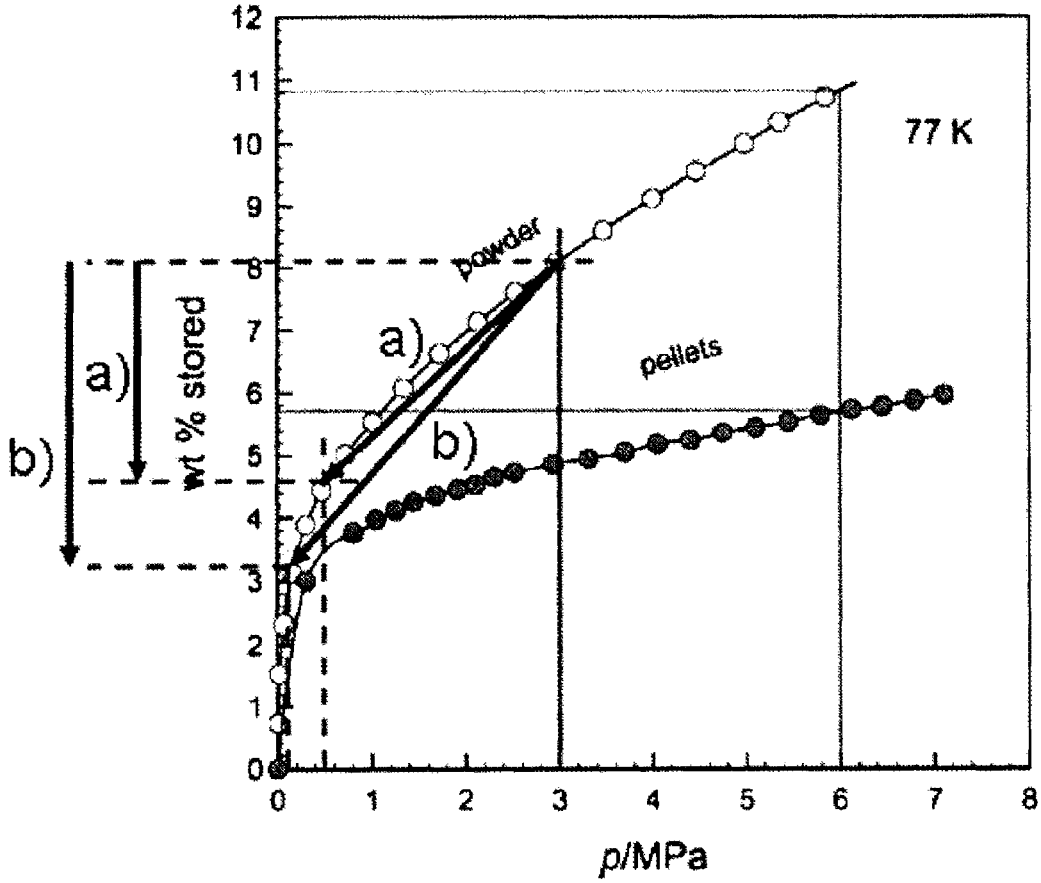
FIG. 4 is a graph illustrating the hydrogen uptake of activated carbon powder and activated carbon pellets as a function of pressure.

FIG. 4 illustrates the gas compressor's 20 role in the system 10 by comparing the weight percentages of hydrogen stored in activated carbon powder and pellets as a function of pressure. FIG. 4 represents a fuel storage vessel with a maximum operating pressure of 30 bars. For exemplary purposes only, the fuel storage vessel of FIG. 4 is supplying a secondary device that requires a feed pressure of 5 bars. As can be seen, activated carbon powder can store 8.1 wt. % hydrogen at the maximum operating pressure. If the pressure in the fuel storage vessel is lowered to the secondary device's feed pressure, the activated carbon powder can store 4.6 wt. % hydrogen. Thus, the activated carbon powder's usable hydrogen capacity for use in the secondary device is 3.5 wt. %. If the pressure in the fuel storage vessel is further lowered to a pressure of 1 bar, the activated carbon powder can store 3.2 wt. % hydrogen. Now, the activated carbon powder's usable hydrogen capacity for use in the secondary device is 4.8 wt. %. Therefore, on the basis of a single fuel storage vessel 12, operating the fuel storage vessel 12 at low pressures increases the amount of fuel available to the secondary device 18 and reduces the refueling frequency of fuel storage vessel 12.

Referring again to FIG. 1, one embodiment of the disclosure includes a process for supplying fuel to a secondary device 18. A fuel supplying system 10 contains a fuel storage vessel 12, a fuel supply line 16, a gas compressor 20, and a secondary device 18. The fuel, which is in a gaseous state, may be stored in the fuel storage vessel 12 at a pressure below that required to feed the secondary device 18. The fuel storage vessel 12 includes a gas adsorbing material 14 for enhancing fuel storage capacity. A gas compressor 20 located in the fuel supply line 16 may be activated to provide fuel to the secondary device 18 at the predetermined feed pressure. Also, activating the gas compressor 20 and delivering fuel to the secondary device 18 further reduces the pressure in the fuel storage vessel 12, thus releasing additional fuel from the gas adsorbing material 14. A pressure regulation system may not be necessary if the secondary device 18 can handle the full pressure range of the fuel storage vessel 12.

In another embodiment of the disclosure, the fuel storage vessel 12, with or without the gas compressor 20, may supply fuel to the secondary device 18 at the predetermined feed pressure. The fuel storage vessel 12 includes a gas adsorbing material 14 for enhancing fuel storage capacity. The fuel storage vessel 12 may be refueled to a pressure well above the predetermined feed pressure of the secondary device 18 in order to maximize the storage capacity of the gas adsorbing material 14. The relatively high pressure of the fuel storage vessel 12 delivers fuel to the secondary device 18 by way of the fuel supply line 16. A pressure regulation system may not be necessary if the secondary device 18 can handle the full pressure range of the fuel storage vessel 12. Also, the gas compressor 20 may be inactive during initial operation because the pressure in the fuel storage vessel 12 is sufficient to supply fuel to the secondary device 18 at the predetermined feed pressure. When the pressure in the fuel storage vessel 12 drops to a predetermined level, the gas compressor 20 activates and delivers the fuel to the secondary device 18 at the predetermined feed pressure. For example, in one embodiment, the predetermined level at which the gas compressor 20 activates may be when the pressure in the fuel storage vessel 12 drops to less than 10% above, at, or below the predetermined feed pressure of the secondary device 18. Also, activating the gas compressor 20 and delivering fuel to the secondary device 18 further reduces the pressure in the fuel storage vessel 12, thus releasing additional fuel from the gas adsorbing material 14.

Figure 2:
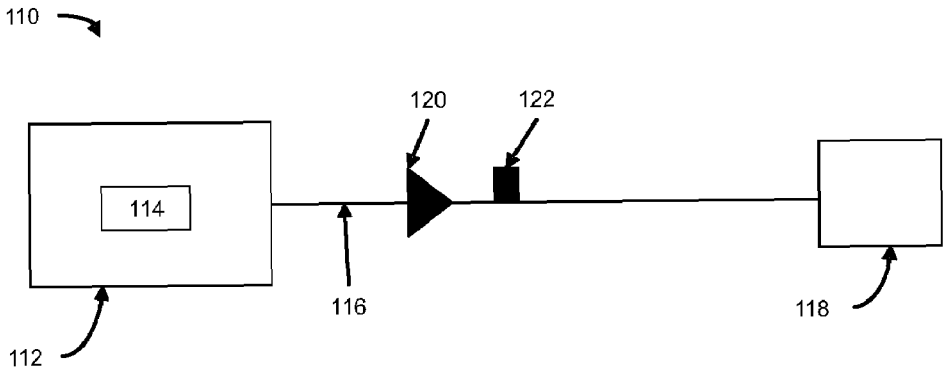
FIG. 2 is a schematic view of fuel supplying system suitable for implementation of a process according to one or more embodiments of the invention.

Another embodiment of the disclosure is shown in FIG. 2. A fuel supplying system 110 includes a fuel storage vessel 112, a fuel supply line 116, a gas compressor 120, a secondary device 118, and one or more pressure regulators 122. The fuel storage vessel 112, with or without the gas compressor 120, may supply fuel to the secondary device 118 at a predetermined feed pressure. The fuel storage vessel 112 may include a gas adsorbing material 114 for enhancing fuel storage capacity. Initially, the fuel storage vessel 112 may be refueled to a pressure well above the predetermined feed pressure of the secondary device 118 in order to maximize the storage capacity of the gas adsorbing material 114. The relatively high pressure of the fuel storage vessel 112 delivers fuel to the secondary device 118 by way of the fuel supply line 116. One or more pressure regulators 122 may be placed in fuel supply line 116 to maintain a predetermined feed pressure to the secondary device 118 if the secondary device is not designed to operate at the high pressure. Similar to the earlier embodiment, the gas compressor 120 may be inactive when the fuel storage vessel 112 is operated at a pressure sufficient enough to deliver fuel to the secondary device 118 at the predetermined feed pressure. However, when the pressure in the fuel storage vessel 112 decreases to a predetermined level, the one or more pressure regulators 122 activate the gas compressor 120. For example, in various embodiments, the predetermined level at which the gas compressor 120 activates may be when the pressure in the fuel storage vessel 112 drops to less than 10% above, at, or below the predetermined feed pressure of the secondary device 118. When activated, the gas compressor 120 lowers the pressure in the fuel storage vessel 112 so that more fuel is released from the gas adsorbing material 114. The gas compressor 120 then delivers the fuel to the secondary device 118 at the predetermined feed pressure.

Figure 3:
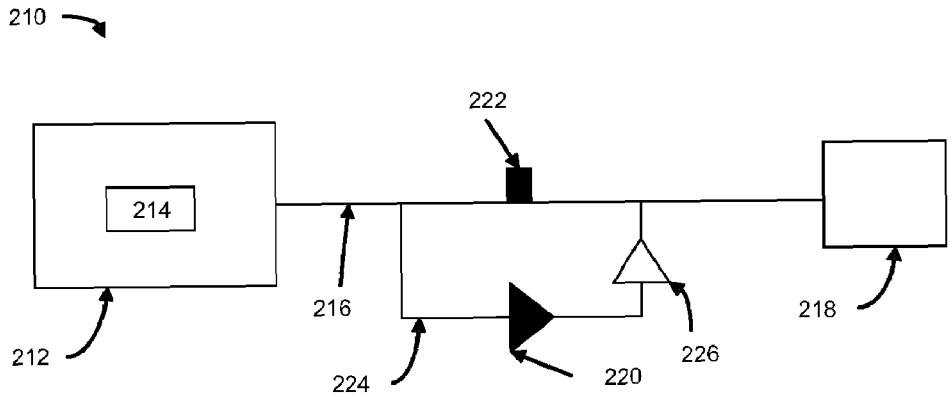
FIG. 3 is a schematic view of fuel supplying system suitable for implementation of a process according to one or more embodiments of the invention.

Another embodiment of the disclosure is shown in FIG. 3. A fuel supplying system 210 includes a fuel storage vessel 212, a first conduit line 216, a gas compressor 220, a secondary device 218, one or more pressure regulators 222, a second conduit line 224, and one or more back pressure valves 226. The fuel storage vessel 212, with or without the gas compressor 220, may supply fuel to the secondary device 218 at a predetermined feed pressure. The fuel storage vessel 212 may include a gas adsorbing material 214 for enhancing fuel storage capacity.

In one embodiment, the first conduit line 216 includes a second conduit line 224 to assist in delivering fuel at a predetermined feed pressure to the secondary device 218. The gas compressor 220 may be located on the second conduit line 224 and one or more back pressure valves 226 may be located on the first conduit line 216 or the second conduit line 224, or both. In this embodiment, one or more back pressure valves 226 may be utilized to keep fuel from flowing in a reverse direction when the gas compressor 220 is activated or not activated. For example, a back pressure valve may be located in the first conduit line 216 to prevent fuel from flowing back towards the fuel storage vessel 212 by way of the first conduit line 216 when the gas compressor 220 is activated and fuel is being delivered to the fuel storage vessel 212 through the second conduit line 224. A back pressure valve may also be located in the second conduit line 224 to prevent fuel from flowing back towards the fuel storage vessel 212 by way of the second conduit line 224 when the gas compressor 220 is not activated and fuel is being delivered to the fuel storage vessel through the first conduit line 224. One or more pressure regulators 222 may be located on the first conduit line 216 to maintain a predetermined feed pressure to the secondary device 218 if the secondary device 218 is not designed to operate at the high pressures of the fuel storage vessel 212 It should be noted that it is possible to switch the location of the one or more pressure regulators 222 with that of the gas compressor 220. This alternative configuration places the one or more pressure regulators 222 on the second conduit line 224 and the gas compressor 220 on the first conduit line 216. It should also be noted that various control configurations known to those or ordinary skill in the art may be used in conjunction with this embodiment to control flow of the fuel through the first conduit line 216 and the second conduit line 224. For example, the first conduit line 216 and the second conduit line 224 may include one or more valves to control the direction of fuel flow through the fuel supplying system 210.

In another embodiment, the first conduit line 216 and the second conduit line 224 may be separate lines to the secondary device 218. The first conduit line 216 may supply fuel to the secondary device 218 when the pressure in the fuel storage vessel is high enough to supply fuel to the secondary device 218 at the predetermined feed pressure. The second conduit line 224 may include a gas compressor 220 that activates when the pressure in the fuel storage vessel 212 falls to a predetermined level. The first conduit line 216 and the second conduit line 224 may contain one or more pressure regulators 222 to maintain a predetermined feed pressure to the secondary device if the secondary device is not designed to operate at the high pressures of the fuel storage vessel 212. The first conduit line 216 and the second conduit line 224 may also include back pressure valves 226 to keep fuel from flowing back towards the fuel storage vessel. Furthermore, various control configurations known to those or ordinary skill in the art may be used in conjunction with this embodiment to control flow of the fuel through the first conduit line 216 and the second conduit line 224.

Still referring to FIG. 3, in one embodiment the fuel storage vessel 212 is initially refueled to a pressure well above the feed pressure of the secondary device 218 in order to maximize the storage capacity of the gas adsorbing material 214. The relatively high pressure of the fuel storage vessel 212 delivers fuel to the secondary device 218 by way of the first conduit line 216 or the second conduit line 224, or both. One or more pressure regulators 222 may be used to maintain a predetermined feed pressure to the secondary device 218. As with the previous embodiments, the gas compressor 220 may be inactive when the pressure in the fuel storage vessel 212 is sufficient to deliver fuel to the secondary device 218 at a predetermined feed pressure. However, when the pressure in the fuel storage vessel 212 decreases to a predetermined level, the gas compressor 220 activates. For example, in various embodiments, the predetermined level at which the gas compressor 220 activates may be when the pressure in the fuel storage vessel 212 drops to less than 10% above, at, or below the predetermined feed pressure of the secondary device 218. As a result of being activated, the gas compressor 220 provides additional pressure to the fuel traveling through the second conduit line 224 so that the fuel supplied to the secondary device 218 is delivered at the predetermined feed pressure. The gas compressor 220 also lowers the pressure in the fuel storage vessel 212 so that more fuel is released from the gas adsorbing material 214. Again, the components of the first conduit line 216 can be switched with the components in the second conduit line 224 without deviating from the scope of this embodiment.

While exemplary embodiments of the disclosure have been described above, it will be recognized and understood that various modifications can be made by those of ordinary skill in the art. The appended claims are intended to cover all such modifications which may fall within the spirit and scope of the invention.

What is claimed is:

1. A process comprising:

providing a fuel storage vessel that is connected to a secondary device by a fuel supply line that includes a gas compressor, said fuel storage vessel configured to contain a gaseous fuel and comprising a gas adsorbing material therein, and wherein said gaseous fuel is supplied to said secondary device at a feed pressure;

filling said fuel storage vessel with said gaseous fuel to a pressure that is above said feed pressure of said secondary device;

delivering said gaseous fuel from said fuel storage vessel to said secondary device, without activating said gas compressor, when said pressure in said fuel storage vessel is at least 10% greater than said feed pressure of said secondary device;

activating said gas compressor to help deliver said gaseous fuel from said fuel storage vessel to said secondary device when said pressure in said fuel storage vessel is less than 10% greater than said feed pressure of said secondary device.

2. A process as set forth in claim 1 further comprising operating said secondary device to consume said gaseous fuel supplied thereto.

3. A process as set forth in claim 1 wherein said secondary device comprises a fuel cell or a combustion engine.

4. A process as set forth in claim 1 wherein said secondary device comprises another storage vessel for storing said gaseous fuel.

5. A process as set forth in claim 1 wherein said fuel comprises at least one of hydrogen or methane.

6. A process as set forth in claim 1 wherein said fuel adsorbing material comprises at least one of a metal hydride, chemical hydride, carbon-based material, zeolite, or combinations thereof.

7. A process as set forth in claim 1 wherein said fuel adsorbing material comprises at least one of $AlH_4$, LiH, NaH, $MgH_2$, $C_{10}H_{18}$, activated carbon powder, activated carbon pellets, or combinations thereof.

8. A process as set forth in claim 1 wherein the feed pressure of the fuel consuming device is between about 3 bars and about 7 bars, and wherein the pressure in the fuel storage vessel ranges from about 0.3 bars to about 100 bars.

9. A process comprising:

providing a storage vessel comprising a gas adsorbing material for storing fuel;

providing a fuel consuming device which is operated at a predetermined feed pressure, said fuel consuming device being connected to said storage vessel by a fuel supply line;

providing a gas compressor in said fuel supply line;

allowing said storage vessel to supply said fuel to said fuel consuming device at said predetermined feed pressure when the pressure in said storage vessel is sufficient to supply said predetermined feed pressure; and activating said gas compressor to supply said fuel to said fuel consuming device when the pressure of said storage vessel is within a predetermined range with respect to said feed pressure.

10. A process as set forth in claim 9 wherein said gas adsorbing material comprises a metal hydride, chemical hydride, carbon-based material, zeolite, or combinations thereof.

11. A process as set forth in claim 9 wherein said fuel adsorbing material comprises at least one of $AlH_4$, LiH, NaH, $MgH_2$, $C_{10}H_{18}$, activated carbon powder, activated carbon pellets, or combinations thereof.

12. A process as set forth in claim 9 wherein said fuel comprises at least one of hydrogen or methane.

13. A process as set forth in claim 9 wherein said pressure of said storage vessel is between 0.3 bar and 100 bar.

14. A process as set forth in claim 9 wherein said pressure of said storage vessel is between 1.1 bar and 25 bar.

15. A process as set forth in claim 9 wherein said predetermined feed pressure is at least 3 bar.

16. A process as set forth in claim 9 wherein said fuel consuming device comprises a fuel cell.

17. A process as set forth in claim 9 wherein said fuel consuming device comprises a combustion engine.

18. A process as set forth in claim 9 further comprising a fuel supply line for delivering said fuel to said fuel consuming device.

19. A process as set forth in claim 9 further comprising one or more pressure regulators to maintain said predetermined feed pressure to said fuel consuming device when said fuel consuming device is not designed to operate at the pressure of said storage vessel.

20. A process as set forth in claim 19 wherein said one or more pressure regulators and said gas compressor are positioned in said fuel supply line.

21. A process as set forth in claim 9 further comprising a first conduit line and a second conduit line for supplying fuel to said fuel consuming device.

22. A process as set forth in claim 9 further comprising one or more back pressure valves to prevent fuel from flowing towards said fuel storage vessel.

23. A process as set forth in claim 9 wherein the predetermined range with respect to said predetermined feed pressure is less than 10% above said predetermined feed pressure.

24. A process as set forth in claim 9 wherein the predetermined range with respect to said predetermined feed pressure is substantially at said predetermined feed pressure.

25. A process as set forth in claim 9 wherein the predetermined range with respect to said predetermined feed pressure is below said predetermined feed pressure.

* * * * *